US008698719B2

(12) United States Patent
Cheng et al.

(10) Patent No.: US 8,698,719 B2
(45) **Date of Patent: *Apr. 15, 2014**

(54) DISPLAYING METHOD FOR FIELD SEQUENTIAL COLOR DISPLAYS USING TWO COLOR FIELDS

(71) Applicant: AU Optronics Corp., Hsinchu (TW)

(72) Inventors: Yu-Kuo Cheng, Kaohsiung (TW); Yi-Pai Huang, Chiayi (TW); Yi-Ru Cheng, Hsinchu (TW); Han-Ping D. Shieh, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/030,169

(22) Filed: Sep. 18, 2013

(65) Prior Publication Data

US 2014/0015871 A1 Jan. 16, 2014

Related U.S. Application Data

(63) Continuation of application No. 12/359,346, filed on Jan. 26, 2009, now Pat. No. 8,564,517.

(30) Foreign Application Priority Data

Oct. 9, 2008 (TW) ..... 97139039 A

(51) Int. Cl.
*G09G 3/36* (2006.01)

(52) U.S. Cl.
USPC ..... 345/88; 345/102

(58) Field of Classification Search
None
See application file for complete search history.

(56) References Cited

U.S. PATENT DOCUMENTS

| | | | | |
|---|---|---|---|---|
| 5,337,068 | A | 8/1994 | Stewart et al. | |
| 6,891,672 | B2 | 5/2005 | Whitehead et al. | |
| 7,057,668 | B2 | 6/2006 | Herrmann | |
| 7,106,505 | B2 | 9/2006 | Whitehead et al. | |
| 7,370,979 | B2 | 5/2008 | Whitehead et al. | |
| 7,952,544 | B2 | 5/2011 | Roberts | |
| 2006/0023003 | A1 * | 2/2006 | Yamanaka | 345/690 |
| 2007/0176943 | A1 | 8/2007 | Cho | |
| 2008/0198114 | A1 | 8/2008 | Roberts et al. | |

(Continued)

OTHER PUBLICATIONS

Cheng, et al., "Perception-Guided Power Minimization for Color Sequential Displays", 2006, pp. 290-295, ACM.

(Continued)

*Primary Examiner* — Joseph Haley
*Assistant Examiner* — Emily Frank
(74) *Attorney, Agent, or Firm* — WPAT, PC; Justin King

(57) ABSTRACT

A displaying method for field sequential color displays using two color fields to produce a full color image is disclosed. The displaying method includes: providing a target full color image, displaying a first color field and displaying a second color field. The target full color image is formed by a first color image optical stimulus, a second color image optical stimulus and a third color image optical stimulus. The first color field displays the first color image optical stimulus and a first part of the third color image optical stimulus, while the second color field displays the second color image optical stimulus and a second part of the third color image optical stimulus, which compensates the shortage of the third color image optical stimulus in the first color field. The target full color image is generated by displaying the first and second color fields in sequence, so as to decrease the displaying frequency of field sequential color displays.

20 Claims, 10 Drawing Sheets

(56) References Cited

U.S. PATENT DOCUMENTS

| | | | | |
|---|---|---|---|---|
| 2009/0021534 | A1* | 1/2009 | Tomizawa et al. | 345/690 |
| 2010/0039367 | A1 | 2/2010 | Tai et al. | |

OTHER PUBLICATIONS

Sekiya, et al., "L-4: Late-News Paper: A Simple and Practical Way to Cope With Color Breakup on Field Sequential Color LCDs", 2006, pp. 1661-1664, SID.

Lee, et al., "Noble measurement method for color breakup artifact in FPDs", pp. 92-97, IMID/IDMC '06 Digest.

Hsu, et al., "A Field Sequential Color LCD base on color Field Arrangement for color Breakup and Flicker Reduction", pp. 59-62, IDW '07.

E.H.A. Langendijk, "Invited: A comparison of three different field sequential color displays", pp. 1809-1812, IDW/AD '05.

* cited by examiner

DISPLAYING METHOD FOR FIELD SEQUENTIAL COLOR DISPLAYS USING TWO COLOR FIELDS

CROSS-REFERENCE TO RELATED APPLICATION

This application is a continuation application of an application Ser. No. 12/359,346 filed on Jan. 26, 2009.

BACKGROUND OF THE INVENTION

1. Technical Field

The present invention relates to a displaying method for field sequential color systems using two color fields, and more particularly to a displaying method for field sequential color displays using two color fields.

2. Description of Related Art

Recently, with the development of the display industry, not only the manufacturing processes of display devices gradually advance to maturity, but also the displaying technology for use with such devices is constantly improved. For example, the field sequential color (FSC) technique, which is applicable to and thus denominates various field sequential color display devices including projectors, FSC liquid crystal displays (LCDs) and so on, can enrich the image quality of display devices and enhance system performance, in addition to lowering production costs.

The field sequential color technique works principally by sequentially displaying monochromatic fields of different colors so that, through time integration by the human visual system, or better known as persistence of vision, the monochromatic fields are visually overlapped to form a full color image according to the principle of additive color mixing. A field sequential color display can show color images in the absence of color filters by controlling the colors of a multi-primary backlight module and changing pixel transmittance or reflectance of a light valve element (e.g., an LCD panel). Hence, the electro-optical conversion efficiency of a field sequential color system is increased while the cost of color filters is saved.

A conventional field sequential color display requires at least the three primary color fields to form a full color image. In other words, the displaying frequency of the color fields must be 180 Hz or above to satisfy such a driving mode. However, in order to cope with a field sequential color LCD having a high displaying frequency of color fields, the liquid crystal cells of the LCD must have a short response time, so that a fast-response liquid crystal mode must be used. As a result, field sequential color LCDs, for example, cannot be mass-produced for commercial use due to the high cost of such liquid crystal mode.

In addition, a field sequential color display is susceptible to serious color break-up (CBU) when driven at a color field displaying frequency of 180 Hz. A paper presented at the 2005 International Display Workshops (IDW) and titled "A comparison of three different field sequential color displays" compares three displaying methods. The conclusion of the paper is that two-field FSC methods have less visible CBU than the three-field (red-green-blue) FSC method. However, the two-field FSC methods described in that paper still depend on the use of color filters and thus lose the advantages considerably.

BRIEF SUMMARY OF THE INVENTION

An objective of the present invention is to provide a displaying method for field sequential color displays using two color fields, wherein a target full color image is generated by displaying two color fields in sequence so as to decrease a displaying frequency of the color fields of the field sequential color displays, thereby allowing the use of commercially available liquid crystal modes such as the twisted nematic (TN), the vertical alignment (VA) or the in-plane switching (IPS) technique as a way to lower the production cost of the field sequential color displays.

Another objective of the present invention is to provide a displaying method for field sequential color displays using two color fields, wherein a target full color image is generated by displaying two color fields, each formed by at least two different color image optical stimuli, thereby enhancing the color rendering capability of the field sequential color displays.

A further objective of the present invention is to provide a displaying method for field sequential color displays using two color fields, wherein a target full color image is generated, and color break-up effectively suppressed, by displaying two color fields, in the absence of color filters.

To achieve these objectives, an embodiment in accordance with the present invention provides a displaying method for field sequential color displays using two color fields, in which the displaying method includes the steps of: providing a target full color image having a first color image optical stimulus of a first color light, a second color image optical stimulus of a second color light and a third color image optical stimulus of a third color light; displaying a first color field including the first color image optical stimulus and a first partial image optical stimulus of the third color image optical stimulus; and displaying a second color field including the second color image optical stimulus and a second partial image optical stimulus of the third color image optical stimulus, wherein the first partial image optical stimulus of the third color image optical stimulus is overlapped with the second partial image optical stimulus of the third color image optical stimulus to produce the third color image optical stimulus.

To achieve the foregoing objectives, another embodiment in accordance with the present invention provides a displaying method for field sequential color displays using two color fields, in which the displaying method includes the steps of: providing a target full color image having a first color image optical stimulus of a first color light, a second color image optical stimulus of a second color light and a third color image optical stimulus of a third color light; obtaining a first color backlight distribution signal and a second color backlight distribution signal, which are derived from the target full color image by applying a zoned backlighting technique; obtaining a first color liquid crystal compensation signal and a second color liquid crystal compensation signal, which are derived from the target full color image by calculating with the first color backlight distribution signal and the second color backlight distribution signal; obtaining a first backlight distribution signal of the third color light and a second backlight distribution signal of the third color light, which are derived from the target full color image by calculating backward with the first color liquid crystal compensation signal and the second color liquid crystal compensation signal; and outputting a first color field and a second color field in sequence, wherein the first color field is output according to the first color liquid crystal compensation signal in conjunction with the first color backlight distribution signal and the first backlight distribution signal of the third color light, and the second color field is output according to the second color liquid crystal compensation signal in conjunction with the second color backlight distribution signal and the second backlight distribution signal of the third color light; wherein an image optical stimulus output according to the first color liquid crystal compensation signal and the first color backlight distribution signal is the first color image optical stimulus, and an image optical stimulus output according to the second color liquid crystal compensation signal and the second color backlight distribution signal is the second color image optical stimulus, while a first partial image optical stimulus of the third color image optical stimulus output according to the first backlight distribution signal of the third color light and the first color liquid crystal compensation signal is overlapped with a second partial image optical stimulus of the third color image optical stimulus output according to the second backlight distribution signal of the third color light and the second color liquid crystal compensation signal to produce the third color image optical stimulus.

The present invention has at least the following advantageous effects:

1. A target full color image is displayed at a decreased displaying frequency of color fields so that fast-response liquid crystal mode can be dispensed with to lower the otherwise high production costs of field sequential color displays;

2. A target full color image is generated by sequentially displaying two color fields without using color filters;

3. The color rendering capability of field sequential color displays is improved by using two color fields each displaying a combination of at least two different color image optical stimuli; and 4. Color break-up is suppressed by decreasing color contrast between color fields.

BRIEF DESCRIPTION OF THE SEVERAL VIEWS OF THE DRAWINGS

The invention as well as a preferred mode of use, further objectives and advantages thereof will be best understood by referring to the following detailed description of illustrative embodiments in conjunction with the accompanying drawings, wherein.

DETAILED DESCRIPTION OF THE PREFERRED EMBODIMENTS

To facilitate understanding of embodiments of the present invention, numeric values are provided in FIGS. 3, 7 and 9 for color image optical stimuli $IM_1$, $IM_2$, $IM_3$, $IM_{31}$, $IM_{32}$, $IM_4$, $IM_{41}$, $IM_{42}$, $IM_5$, $IM_{51}$ and $IM_{52}$ of a target full color image 10, a first color field 40 and a second color field 50, as explained below, to illustrate relations among the color image optical stimuli. These numeric values are intended only to show relative optical stimuli, but not actual values, of the color image optical stimuli $IM_1$, $IM_2$, $IM_3$, $IM_{31}$, $IM_{32}$, $IM_4$, $IM_{41}$, $IM_{42}$, $IM_5$, $IM_{51}$ and $IM_{52}$.

Herein, "color image optical stimulus" is defined as an electromagnetic wave which is capable of arousing a visual response and whose wavelength is within a specific range (from about 380 nm to about 780 nm), wherein the visual response includes such visual perceptions as hue, brightness, lightness, colorfulness, chroma, saturation and so on. The wavelength of a color image optical stimulus is related to magnitude, frequency and phase, among which magnitude is the one directly related to visual response. More particularly, the square of magnitude is in direct proportion to intensity. On the other hand, frequency is in inverse proportion to wavelength while being related to hue.

Figure 1:
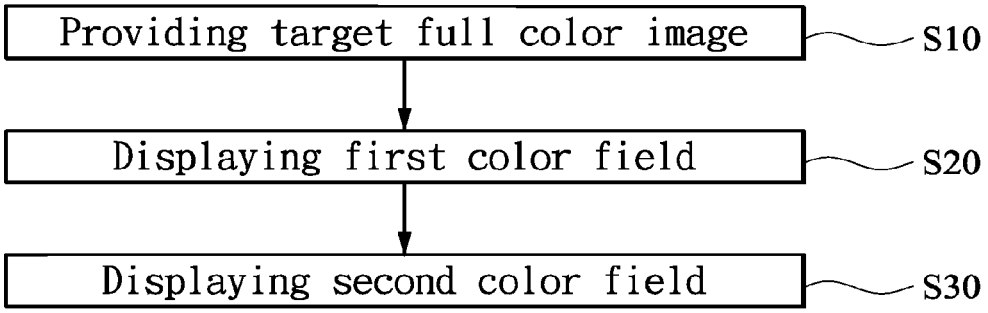
FIG. 1 is a flowchart of a displaying method for field sequential color displays using two color fields according to a first embodiment of the present invention.

Referring to FIG. 1, a displaying method for field sequential color displays using two color fields according to a first embodiment of the present invention includes the steps of: providing a target full color image (S10), displaying a first color field (S20) and displaying a second color field (S30).

Figure 2:
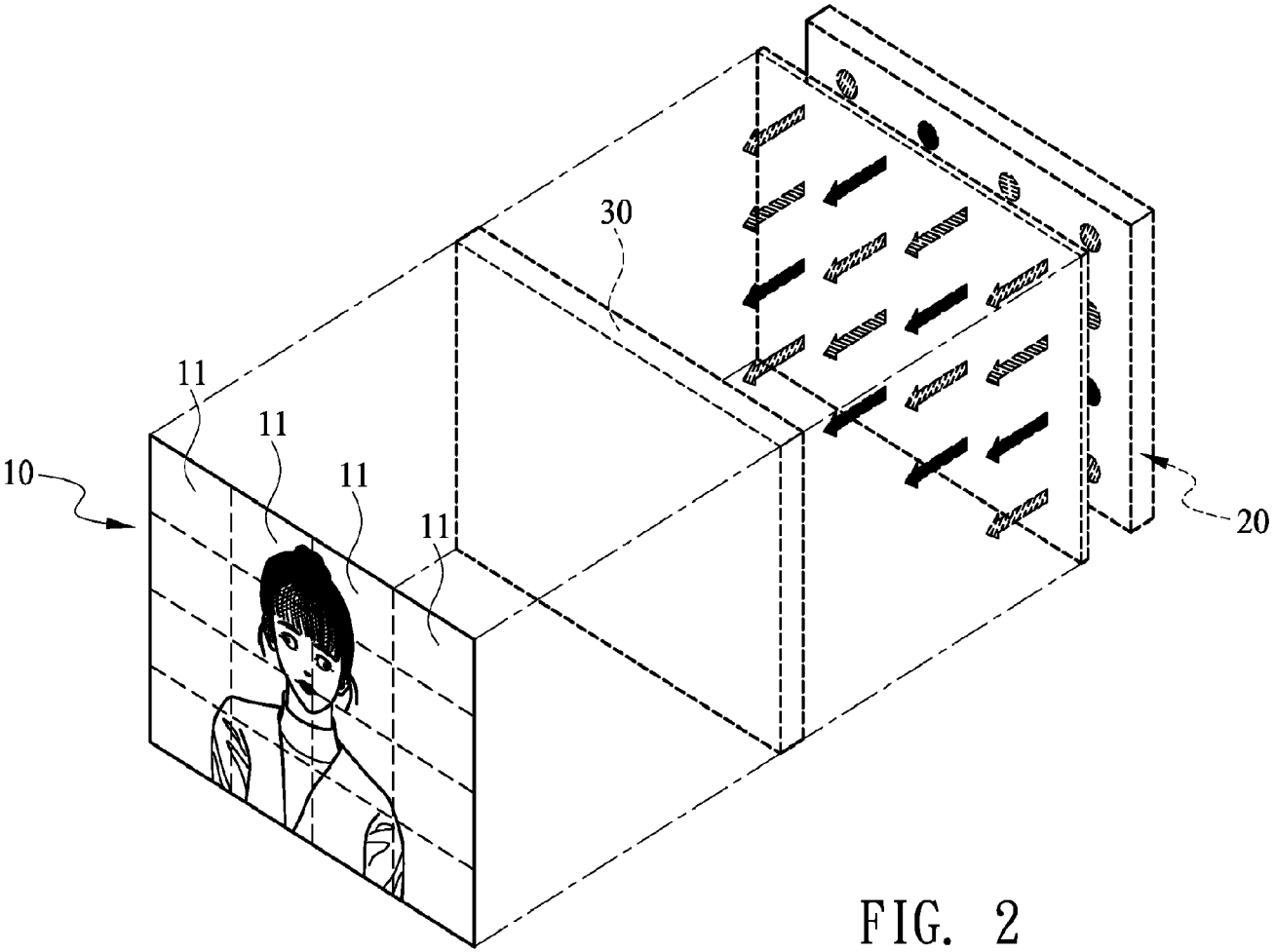
FIG. 2 is a schematic drawing showing an embodiment of a target full color image according to the present invention.

The step S10 of providing a target full color image is now explained in detail. Referring to FIGS. 2 and 3, which shows a target full color image 10 in illustration of the present embodiment, the target full color image 10 at least includes a first color image optical stimulus $IM_1$ of a first color light $CL_1$, a second color image optical stimulus $IM_2$ of a second color light $CL_2$ and a third color image optical stimulus $IM_3$ of a third color light $CL_3$. The first color light $CL_1$, the second color light $CL_2$ and the third color light $CL_3$ can be monochromatic. For example, the first, second and third color lights $CL_1$, $CL_2$ and $CL_3$ can be composed of a red light, a green light and a blue light. More specifically, the first, second and third color lights $CL_1$, $CL_2$ and $CL_3$ can be red, blue and green, respectively, or blue, green and red, respectively, but are not limited to the aforesaid combinations.

As shown in FIGS. 2, 3, 7 and 9, the color image optical stimuli $IM_1$, $IM_2$, $IM_3$, $IM_{31}$, $IM_{32}$, $IM_4$, $IM_{41}$, $IM_{42}$, $IM_5$, $IM_{51}$ and $IM_{52}$ are the combined results of backlight distribution of each color light emitted by a backlight module 20 and the liquid crystal transmittance of a liquid crystal panel 30. Therefore, the color image optical stimuli $IM_1$, $IM_2$, $IM_3$, $IM_{31}$, $IM_{32}$, $IM_4$, $IM_{41}$, $IM_{42}$, $IM_S$, $IM_{51}$ and $IM_{52}$ can be displayed by controlling a backlight distribution signal of each color light and a liquid crystal compensation signal.

In order to render the colors of the target full color image 10 more effectively, each of the first, second and third color lights $CL_1$, $CL_2$ and $CL_3$ can be a mixture of multiple color lights. For example, if the third color light $CL_3$ is a green light, the third color light $CL_3$ can be obtained by mixing a yellow light with a cyan light. In addition, the target full color image 10 can be segmented into a plurality of display zones 11 so that the backlight distribution signal of each color light as well as the liquid crystal compensation signal can be controlled for each display zone 11 individually.

The step S20 of displaying a first color field is explained below. Referring to FIG. 3, a first color field 40 includes the first color image optical stimulus $IM_1$ and a first partial image optical stimulus $IM_{31}$ of the third color image optical stimulus $IM_3$. Since the third color light $CL_3$ may be a color light that takes a less prominent role in the target full color image 10 or alternatively, be a color light to which the human eye is the least sensitive, e.g., a blue light, color presentation of the entire image will not be compromised by dividing the third color image optical stimulus $IM_3$ into the first partial image optical stimulus $IM_{31}$ and a second partial image optical stimulus $IM_{32}$ and displaying the first and second partial image optical stimuli $IM_{31}$ and $IM_{32}$ in the first color field 40 and a second color field 50, respectively.

Figure 4:
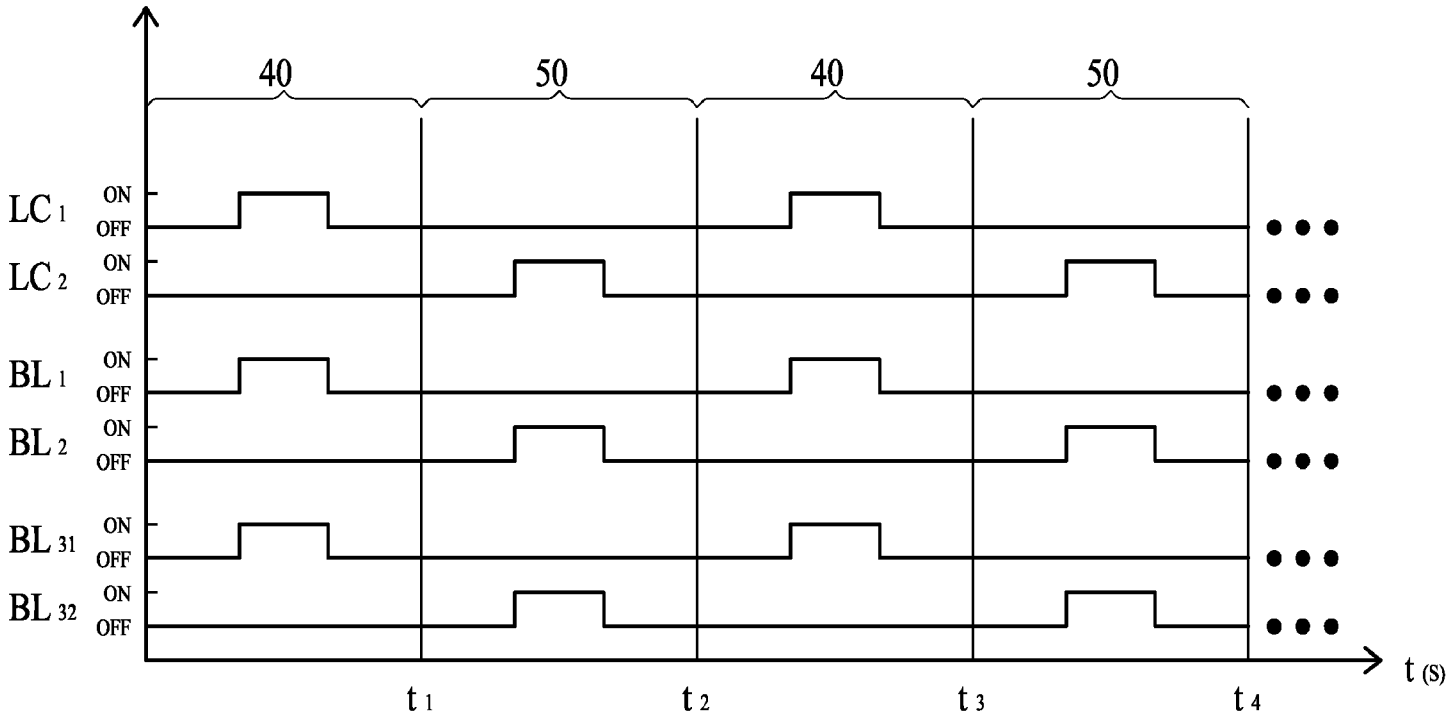
FIG. 4 is a first embodiment of a time sequence diagram of the displaying method according to the present invention.

As shown in FIG. 4, the first color image optical stimulus $IM_1$ is an image optical stimulus output according to a first color backlight distribution signal $BL_1$ and a first color liquid crystal compensation signal $LC_1$. The first color backlight distribution signal $BL_1$ can be an appropriate backlight distribution signal obtained from the target full color image 10 by applying a zoned backlighting technique. On the other hand, the first color liquid crystal compensation signal $LC_1$ can be derived from the target full color image 10 by calculating with the first color backlight distribution signal $BL_1$. The aforesaid zoned backlighting technique is described in more detail in the disclosures of U.S. Pat. Nos. 6,891,672; 7,106,505 and 7,370,979, for example.

In other words, the first color backlight distribution signal $BL_1$ can be obtained from the first color image optical stimulus $IM_1$ of the target full color image 10, and be used to control backlight distribution of the first color light $CL_1$ in the backlight module 20. On the other hand, the first color liquid crystal compensation signal $LC_1$ can be derived from the first color backlight distribution signal $BL_1$ and be used to control the liquid crystal transmittance of the liquid crystal panel 30. Thus, the first color image optical stimulus $IM_1$ can be displayed according to the first color backlight distribution signal $BL_1$ and the first color liquid crystal compensation signal $LC_1$.

The step S30 of displaying a second color field is now explained as follows. As shown in FIG. 3, the second color field 50 includes the second color image optical stimulus $IM_2$ and the second partial image optical stimulus $IM_{32}$ of the third color image optical stimulus $IM_3$. The first partial image optical stimulus $IM_{31}$ of the third color image optical stimulus $IM_3$ in the first color field 40 is overlapped with the second partial image optical stimulus $IM_{32}$ of the third color image optical stimulus $IM_3$ in the second color field 50 to produce the same displaying effect as that of the third color image optical stimulus $IM_3$.

As shown in FIG. 4, the second color image optical stimulus $IM_2$ is an image optical stimulus output according to a second color backlight distribution signal $BL_2$ and a second color liquid crystal compensation signal $LC_2$. Similar to the first color backlight distribution signal $BL_1$ and the first color liquid crystal compensation signal $LC_1$, the second backlight distribution signal $BL_2$ can be obtained from the target full color image 10 by applying the zoned backlighting technique, and the second color liquid crystal compensation signal $LC_2$ can be derived from the target full color image 10 by calculating with the second color backlight distribution signal $BL_2$. The second color backlight distribution signal $BL_2$ can be used to control backlight distribution of the second color light $CL_2$ in the backlight module 20 while the second color liquid crystal compensation signal $LC_2$ can be used to control the liquid crystal transmittance of the liquid crystal panel 30, thereby displaying the second color image optical stimulus $IM_2$.

The first partial image optical stimulus $IM_{31}$ of the third color image optical stimulus $IM_3$, as part of the image optical stimuli displayed in the first color field 40, is output according to the first color liquid crystal compensation signal $LC_1$ and a first backlight distribution signal $BL_{31}$ of the third color light $CL_3$. The first backlight distribution signal $BL_{31}$ of the third color light $CL_3$ can be derived from the target full color image 10 by calculating backward with the first color liquid crystal compensation signal $LC_1$.

Analogously, the second partial image optical stimulus $IM_{32}$ of the third color image optical stimulus $IM_3$ is displayed in the second color field 50, and thus an image optical stimulus output according to the second color liquid crystal compensation signal $LC_2$ and a second backlight distribution signal $BL_{32}$ of the third color light $CL_3$. The second backlight distribution signal $BL_{32}$ of the third color light $CL_3$ can be obtained from a difference between the third color image optical stimulus $IM_3$ of the target full color image 10 and the first partial image optical stimulus $IM_{31}$ of the third color image optical stimulus $IM_3$ in the first color field 40, i.e., the second partial image optical stimulus $IM_{32}$ of the third color image optical stimulus $IM_3$ in the second color field 50, by calculating backward with the second color liquid crystal compensation signal $LC_2$.

Figure 5:
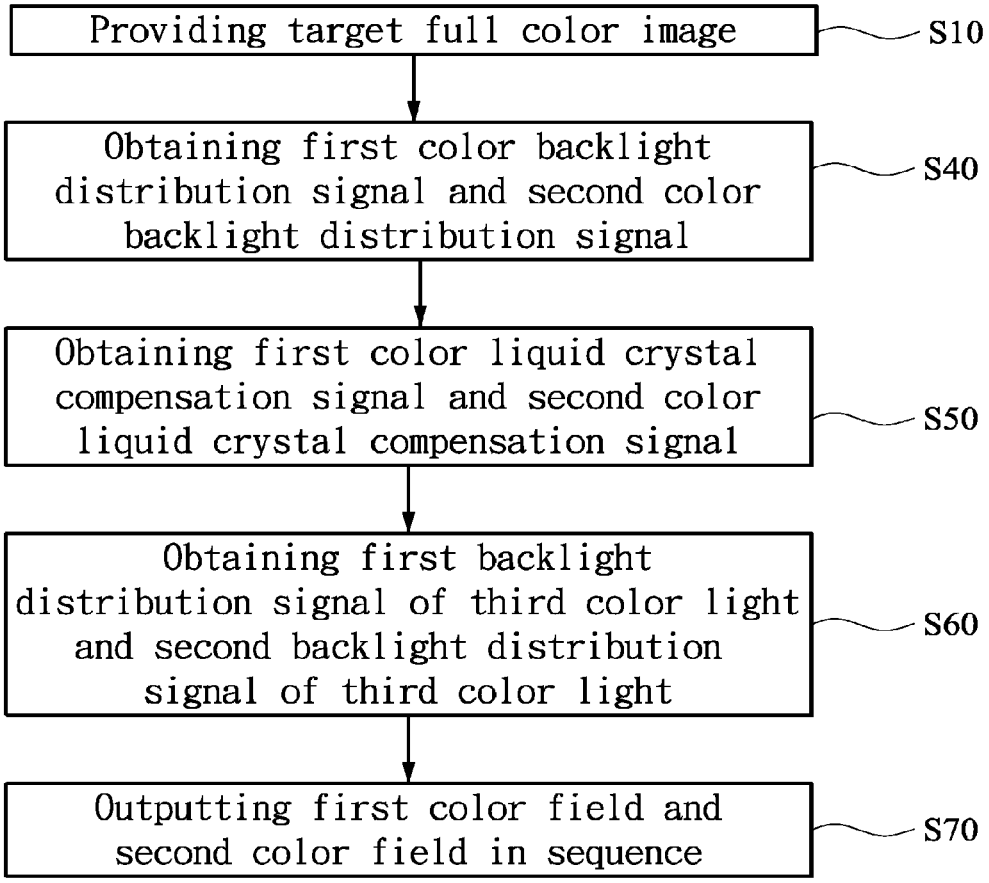
FIG. 5 is a flowchart of a displaying method for field sequential color displays using two color fields according to a second embodiment of the present invention.

FIG. 5 shows a flowchart of a second embodiment of the present invention as a more detailed description of the displaying method disclosed in the first embodiment. As shown in FIG. 5, the steps of the displaying method for field sequential color displays using two color fields according to the first embodiment are further divided into the following steps of: providing a target full color image (S10); obtaining a first color backlight distribution signal and a second color backlight distribution signal (S40); obtaining a first color liquid crystal compensation signal and a second color liquid crystal compensation signal (S50); obtaining a first backlight distribution signal of a third color light and a second backlight distribution signal of the third color light (S60); and outputting a first color field and a second color field in sequence (S70).

At the step S40 of obtaining a first color backlight distribution signal and a second color backlight distribution signal, a first color backlight distribution signal $BL_S$ and a second color backlight distribution signal $BL_2$ are obtained from a target full color image 10 by applying the zoned backlighting technique, so as to produce backlight distribution signals of a first color light $CL_1$ and a second color light $CL_2$ to be output in a first color field 40 and a second color field 50, respectively.

At the step S50 of obtaining a first color liquid crystal compensation signal and a second color liquid crystal compensation signal, a first color liquid crystal compensation signal $LC_1$ and a second color liquid crystal compensation signal $LC_2$ are derived from the target full color image 10 by calculating with the first color backlight distribution signal $BL_S$ and the second color backlight distribution signal $BL_2$ obtained from the previous step. The first color backlight distribution signal $BL_1$ and the first color liquid crystal compensation signal $LC_1$ contribute jointly to displaying a first color image optical stimulus $IM_1$, while the second color backlight distribution signal $BL_2$ and the second color liquid crystal compensation signal $LC_2$ contribute jointly to displaying a second color image optical stimulus $IM_2$.

At the step S60 of obtaining a first backlight distribution signal of a third color light and a second backlight distribution signal of the third color light, an appropriate first backlight distribution signal $BL_{31}$ of a third color light $CL_3$ and an appropriate second backlight distribution signal $BL_{32}$ of the third color light $CL_3$ are derived from the target full color image 10 by calculating backward with the first color liquid crystal compensation signal $LC_1$ and the second color liquid crystal compensation signal $LC_2$, so that an image optical stimulus output according to the first backlight distribution signal $BL_{31}$ of the third color light $CL_3$ and the first color liquid crystal compensation signal $LC_1$ is overlapped with an image optical stimulus output according to the second backlight distribution signal $BL_{32}$ of the third color light $CL_3$ and the second color liquid crystal compensation signal $LC_2$ to produce a third color image optical stimulus $IM_3$. Thereby, the two parts of the third color image optical stimulus $IM_3$ are allowed to be displayed separately in the two color fields 40 and 50.

At the step S70 of outputting a first color filed and a second color field in sequence, as shown in FIG. 4, the first color field 40 is output according to the first color liquid crystal compensation signal $LC_1$ in conjunction with the first color backlight distribution signal $BL_1$ and the first backlight distribution signal $BL_{31}$ of the third color light $CL_3$, and the second color field 50 is output according to the second color liquid crystal compensation signal $LC_2$ in conjunction with the second color backlight distribution signal $BL_2$ and the second backlight distribution signal $BL_{32}$ of the third color light $CL_3$, wherein the first and second color fields 40 and 50 are output in sequence.

For example, a typical field sequential color display displays full color images at an image displaying frequency of 60 Hz. Given that each full color image is formed by three overlapped fields, the minimum field displaying frequency required will be 180 Hz. However, according to the present embodiment, wherein the target full color image 10 is displayed by outputting the first and second color fields 40 and 50 in sequence, it is possible to use a field sequential color display having a field displaying frequency lower than 180 Hz.

For example, the first and second color fields 40 and 50 are displayed at a color field displaying frequency of 120 Hz. In this case, time points t1, t2, t3, t4 . . . in FIG. 4 are 1/120 second, 2/120 second, 3/120 second, 4/120 second . . . , respectively. However, it should be noted that the image displaying frequency and the color field displaying frequency in the present embodiment are not limited to 60 Hz and 120 Hz, respectively, but are adjustable to suit practical needs. By outputting two color fields 40 and 50 in sequence and displaying the target images at an image displaying frequency of 60 Hz, continuous display of full color images is achieved.

Since the target full color image 10 is displayed by outputting the first and second color fields 40 and 50 in sequence without compromising the display quality of the target full color image 10, the displaying method according to the present embodiment can attain acceptable image quality in the absence of fast-response liquid crystal mode, which is substantially indispensable to field sequential color displays in general, and thus lower the production costs of field sequential color displays.

In addition, since each of the first and second color fields 40 and 50 includes image optical stimuli of at least two color lights, e.g., the first color field 40 includes a red image optical stimulus and a part of a blue image optical stimulus while the second color field 50 includes a green image optical stimulus and the remaining part of the blue image optical stimulus, color contrast between the two color fields 40 and 50 is lower than when each color field displays an image optical stimulus of one and only color light, thereby suppressing color breakup.

Figure 6:
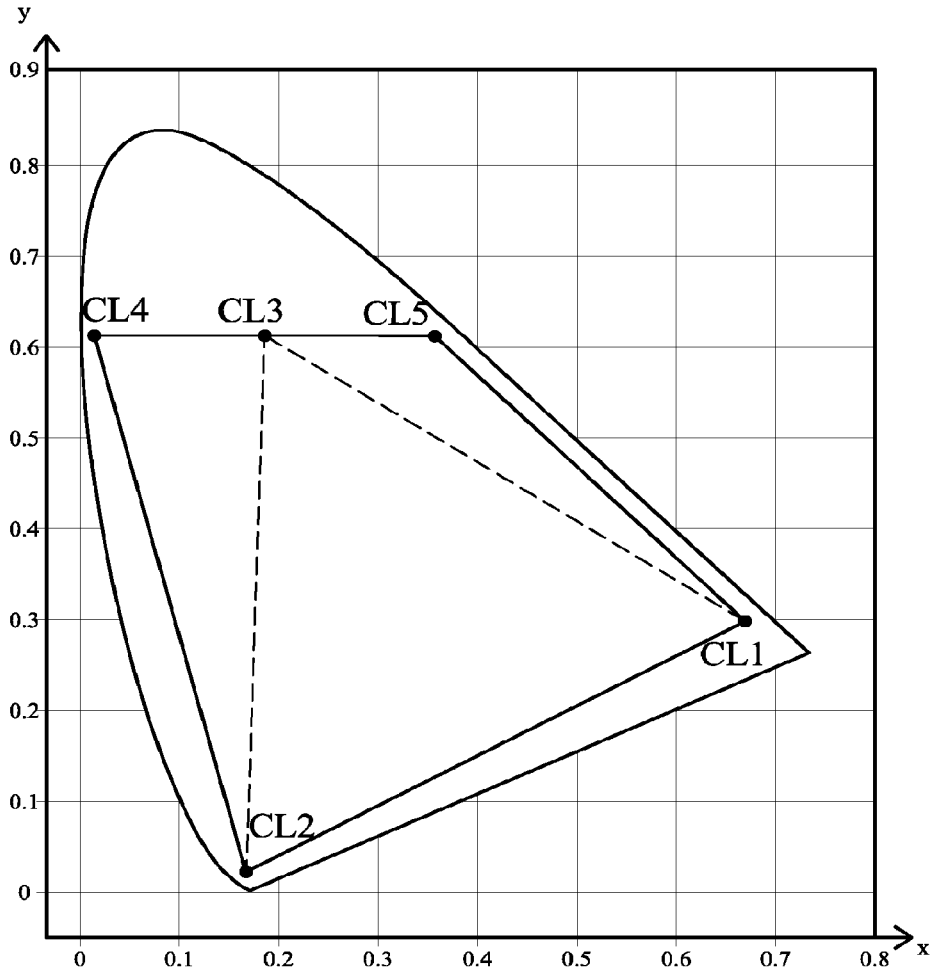
FIG. 6 is a CIE 1931 xy chromaticity diagram based on the principle of additive color mixing.

Referring to FIG. 6, in order to enhance the color rendering capability of field sequential color displays, the principle of additive color mixing is applied so that a fourth color light $CL_4$ and a fifth color light $CL_5$ are mixed to produce the third color light $CL_3$. For example, if the fourth and fifth color lights $CL_4$ and $CL_5$ are cyan and yellow lights, respectively, then according to the principle of additive color mixing, they are mixed to produce a green light as the third color light $CL_3$.

A fourth color image optical stimulus $IM_4$ of the fourth color light $CL_4$ is produced by overlapping a first partial image optical stimulus $IM_{41}$ of the fourth color image optical stimulus $IM_4$ with a second partial image optical stimulus $IM_{42}$ of the fourth color image optical stimulus $IM_4$. Similarly, a fifth color image optical stimulus $IM_5$ of the fifth color light $CL_5$ is produced by overlapping a first partial image optical stimulus $IM_{51}$ of the fifth color image optical stimulus $IM_5$ with a second partial image optical stimulus $IM_{52}$ of the fifth color image optical stimulus $IM_5$.

Figure 7:
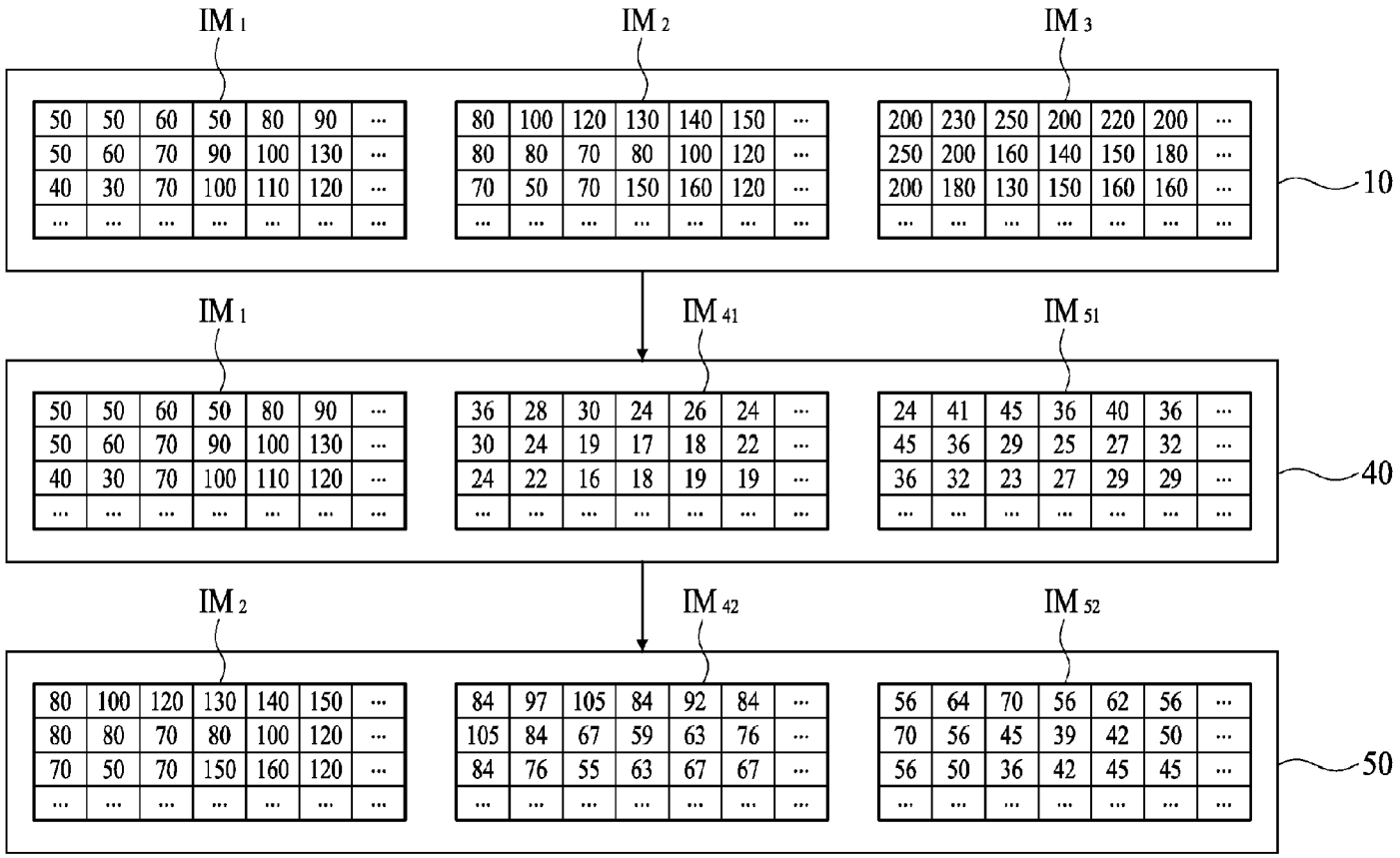
FIG. 7 is a schematic drawing showing a second illustrative application of the displaying method according to the present invention.

Therefore, as shown in FIG. 7, the first partial image optical stimulus $IM_{31}$ of the third color image optical stimulus $IM_3$ in the first color field 40 is formed by the first partial image optical stimulus $IM_{41}$ of the fourth color image optical stimulus $IM_4$ and the first partial image optical stimulus $IM_{51}$ of the fifth color image optical stimulus $IM_5$, while the remaining part of the third color image optical stimulus $IM_3$, i.e., the second partial image optical stimulus $IM_{32}$ of the third color image optical stimulus $IM_3$, is compensated for in the second color field 50 and formed by the second partial image optical stimulus $IM_{42}$ of the fourth color image optical stimulus $IM_4$ and the second partial image optical stimulus $IM_{52}$ of the fifth color image optical stimulus $IM_5$, thereby increasing the color rendering capability of field sequential color displays.

Since the first partial image optical stimulus $IM_{41}$ of the fourth color image optical stimulus $IM_4$ and the first partial image optical stimulus $IM_{51}$ of the fifth color image optical stimulus $IM_5$ are image optical stimuli displayed in the first color field 40, a first backlight distribution signal $BL_{41}$ of the fourth color light $CL_4$ and a first backlight distribution signal $BL_{51}$ of the fifth color light $CL_5$ are derived from the target full color image 10 by calculating backward with the first color liquid crystal compensation signal $LC_1$, and contribute in conjunction with the first color liquid crystal compensation signal $LC_1$ to displaying a desired image optical stimulus of the target full color image 10.

Similarly, since the second partial image optical stimulus $IM_{42}$ of the fourth color image optical stimulus $IM_4$ and the second partial image optical stimulus $IM_{52}$ of the fifth color image optical stimulus $IM_5$ are both image optical stimuli displayed in the second color field 50, a second backlight distribution signal $BL_{42}$ of the fourth color light $CL_4$ and a second backlight distribution signal $BL_{52}$ of the fifth color light $CL_5$ are derived from the target full color image 10 by calculating backward with the second color liquid crystal compensation signal $LC_2$, and contribute in conjunction with the second color liquid crystal compensation signal $LC_2$ to displaying a desired image optical stimulus of the target full color image 10.

Consequently, according to the principle of additive color mixing, the first backlight distribution signal $BL_{31}$ of the third color light $CL_3$ comprises the first backlight distribution signal $BL_{41}$ of the fourth color light $CL_4$ and the first backlight distribution signal $BL_{51}$ of the fifth color light $CL_5$, and the second backlight distribution signal $BL_{32}$ of the third color light $CL_3$ comprises the second backlight distribution signal $BL_{42}$ of the fourth color light $CL_4$ and the second backlight distribution signal $BL_{52}$ of the fifth color light $CL_5$.

Figure 8:
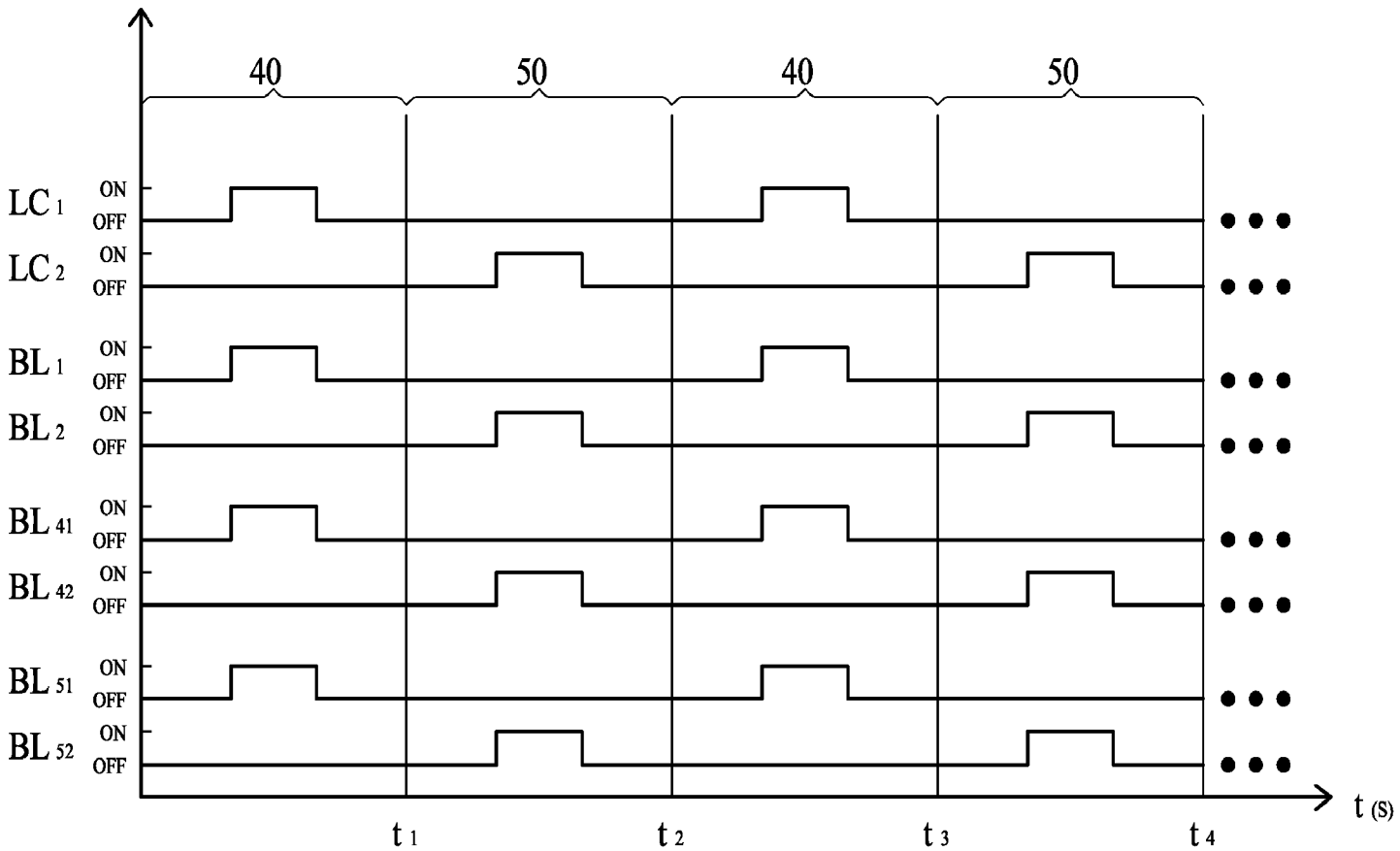
FIG. 8 is a second embodiment of the time sequence diagram of the displaying method according to the present invention.

In other words, as shown in FIG. 8, the first color field 40 is displayed according to the first color liquid crystal compensation signal $LC_1$ in conjunction with the first color backlight distribution signal $BL_1$, the first backlight distribution signal $BL_{41}$ of the fourth color light $CL_4$ and the first backlight distribution signal $BL_{51}$ of the fifth color light $CL_5$. On the other hand, the second color field 50 is displayed according to the second color liquid crystal compensation signal $LC_2$ in conjunction with the second color backlight distribution signal $BL_2$, the second backlight distribution signal $BL_{42}$ of the fourth color light $CL_4$ and the second backlight distribution signal $BL_{52}$ of the fifth color light $CL_5$.

For example, the first and second color fields 40 and 50 can also be displayed at a color field displaying frequency of 120 Hz, so that, with time points t1, t2, t3, t4 . . . in FIG. 8 being 1/120 second, 2/120 second, 3/120 second, 4/120 second . . . , respectively, the first and second color fields 40 and 50 are sequentially displayed to generate the target full color image 10.

Figure 9:
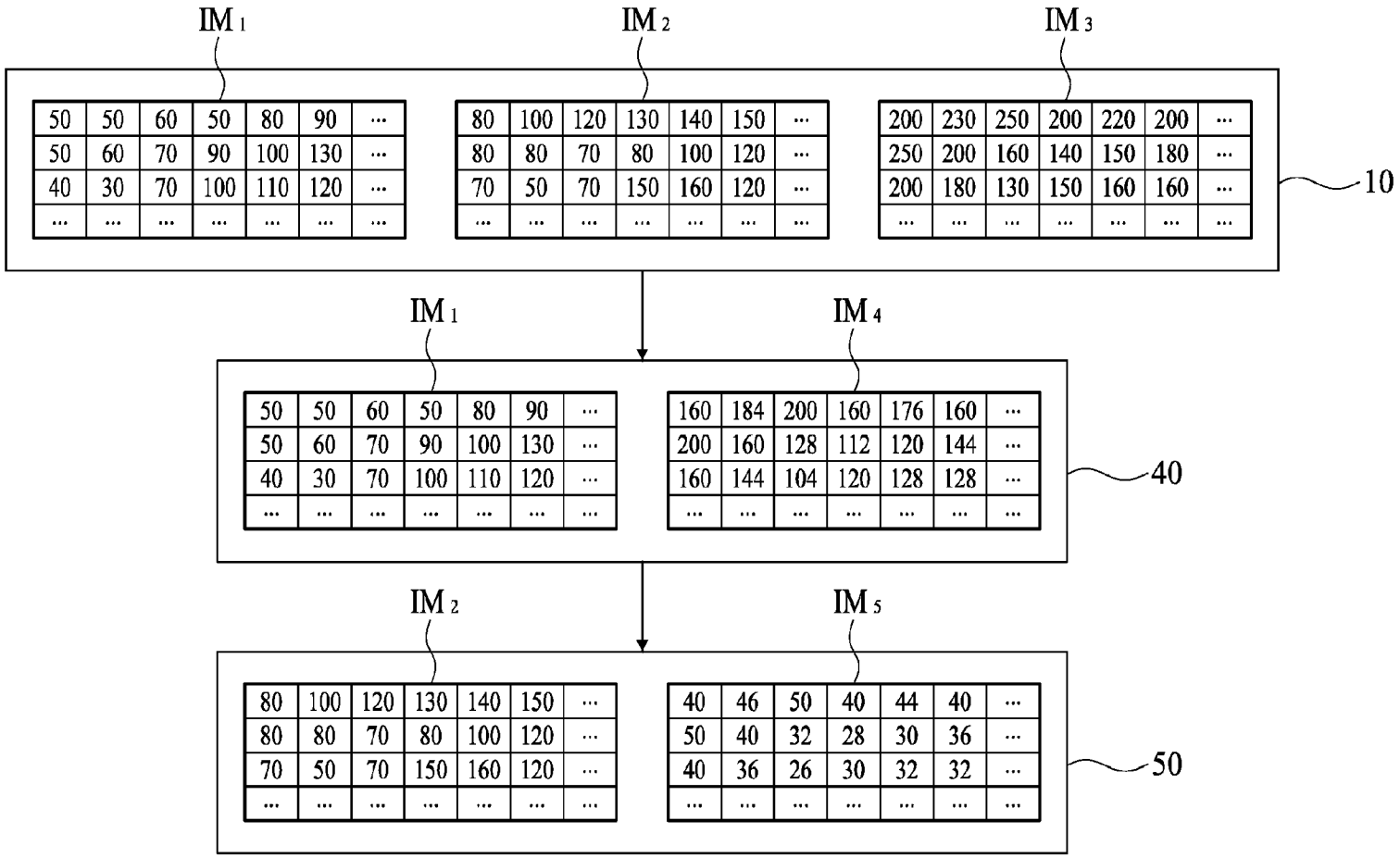
FIG. 9 is a schematic drawing showing a third illustrative application of the displaying method according to the present invention.

Referring now to FIG. 9, in order to reduce the complexity in controlling the backlight module 20, the first color field 40 is formed by the first color image optical stimulus $IM_1$ and the fourth color image optical stimulus $IM_4$, while the second color field 50 is formed by the second color image optical stimulus $IM_2$ and the fifth color image optical stimulus $IM_5$, wherein the fourth color image optical stimulus $IM_4$ and the fifth color image optical stimulus $IM_5$ overlap to produce the same image optical stimulus as the third color image optical stimulus $IM_3$, thereby displaying the third color image optical stimulus $IM_3$.

Since the fourth color image optical stimulus $IM_4$ is an image optical stimulus displayed in the first color field 40, a fourth color backlight distribution signal $BL_4$ of the fourth color light $CL_4$ can be derived from the target full color image 10 by calculating backward with the first color liquid crystal compensation signal $LC_1$, and function in conjunction therewith. Analogously, since the fifth color image optical stimulus $IM_5$ is an image optical stimulus displayed in the second color field 50, a fifth color backlight distribution signal $BL_5$ of the fifth color light $CL_5$ can also be derived from the target full color image 10 by calculating backward with the second color liquid crystal compensation signal $LC_2$, and function in conjunction therewith. Thereby, a desired image optical stimulus of the target full color image 10 is achieved.

Figure 3:
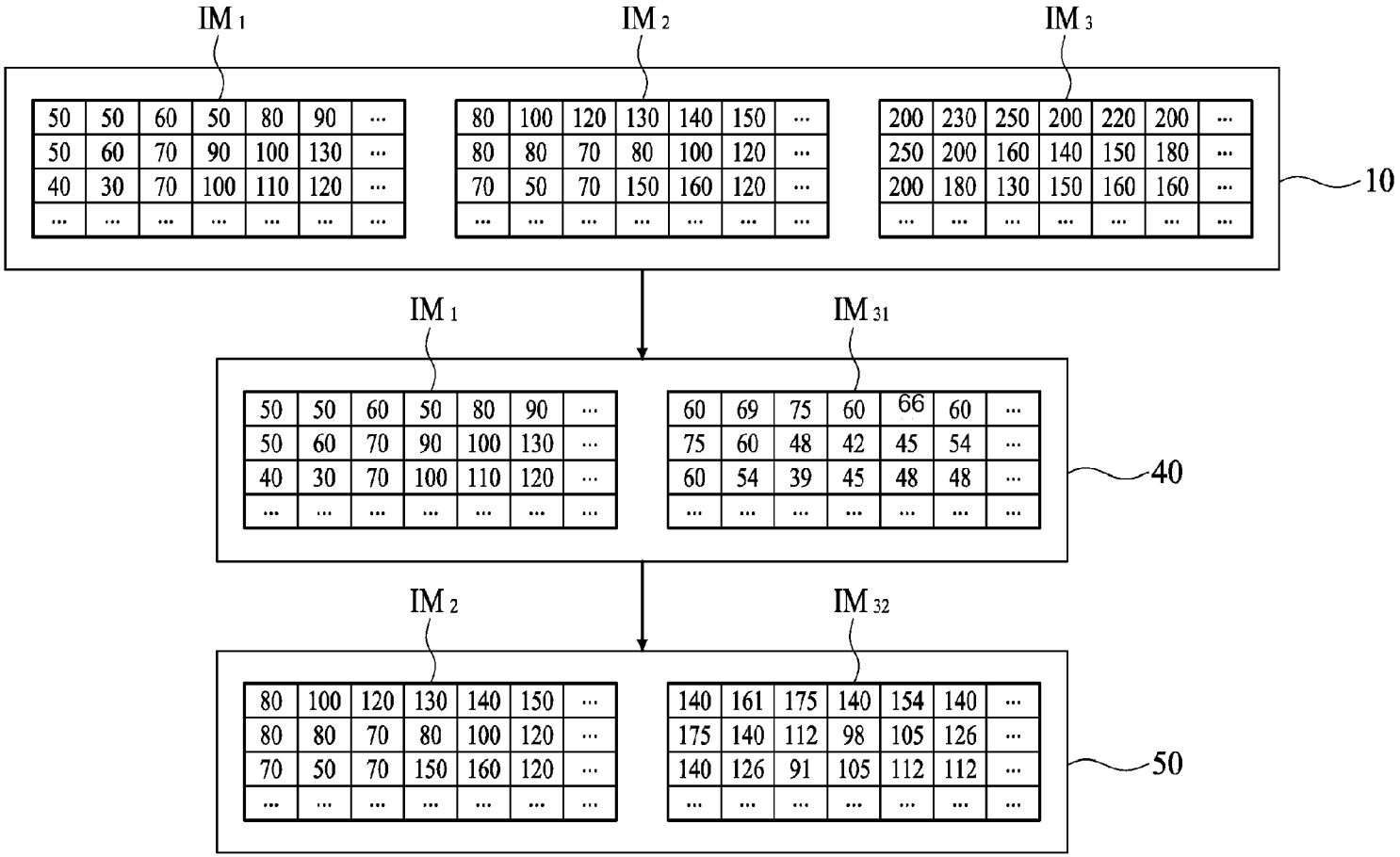
FIG. 3 is a schematic drawing showing a first illustrative application of the displaying method according to the present invention.

In other words, according to the principle of additive color mixing, the first backlight distribution signal $BL_{31}$ and the second backlight distribution signal $BL_{32}$ of the third color light $CL_3$ in the FIG. 3 can be replaced by the fourth color backlight distribution signal $BL_4$ of the fourth color light $CL_4$ and the fifth color backlight distribution signal $BL_{52}$ of the fifth color light $CL_5$, respectively.

Figure 10:
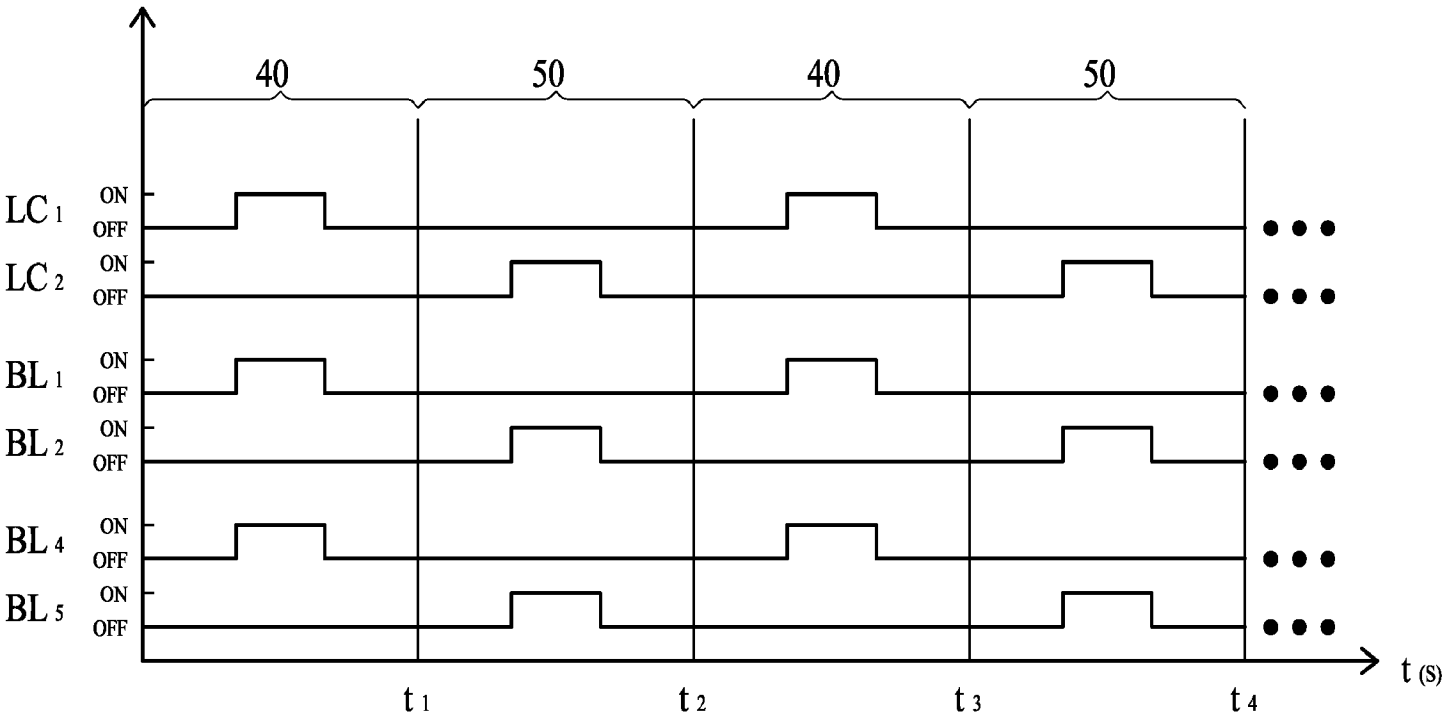
FIG. 10 is a third embodiment of the time sequence diagram of the displaying method according to the present invention.

Referring to FIG. 10, the first color field 40 is displayed according to the first color liquid crystal compensation signal $LC_1$ in conjunction with the first color backlight distribution signal $BL_1$ and the fourth color backlight distribution signal $BL_4$, while the second color field 50 is displayed according to the second color liquid crystal compensation signal $LC_2$ in conjunction with the second color backlight distribution signal $BL_2$ and the fifth color backlight distribution signal $BL_5$. The first and second color fields 40 and 50 can be displayed at a color field displaying frequency of 120 Hz, so that, with time points t1, t2, t3, t4 . . . in FIG. 10 being 1/120 second, 2/120 second, 3/120 second, 4/120 second . . . , respectively, the first and second color fields 40 and 50 are sequentially displayed to generate the target full color image 10.

As the target full color image 10 is displayed by outputting the two color fields 40 and 50 in sequence, the displaying frequency of the color fields 40 and 50 can be lowered to allow the use of field sequential color displays having a relatively low color field displaying frequency. Consequently, fast-response liquid crystal mode can be dispensed with to reduce the otherwise high production costs of field sequential color displays.

The embodiments described above are provided to illustrate the features of the present invention so that a person skilled in the art is enabled to understand and implement the contents disclosed herein. It is understood, however, that the embodiments are not intended to limit the scope of the present invention. Therefore, all equivalent changes or modifications which do not depart from the spirit of the present invention should be encompassed by the appended claims.

What is claimed is:

1. A displaying method for field sequential color displays comprising:

providing a target full color image having a first color image optical stimulus of a first color light, a second color image optical stimulus of a second color light and a third color image optical stimulus of a third color light, wherein the third color image optical stimulus comprises a first partial image optical stimulus and a second partial image optical stimulus;

displaying a first color field comprising the first color image optical stimulus and a first partial image optical stimulus of the third color image optical stimulus; and displaying a second color field comprising the second color image optical stimulus and a second partial image optical stimulus of the third color image optical stimulus.

2. The displaying method of claim 1, wherein the first partial image optical stimulus of the third color image optical stimulus is accumulated with the second partial image optical stimulus of the third color image optical stimulus to produce the third color image optical stimulus.

3. The displaying method of claim 2, wherein each of the first color light, the second color light and the third color light is a monochromatic light or a mixture of a plurality of color lights.

4. The displaying method of claim 2, wherein the first color image optical stimulus is output according to a first color backlight distribution signal used to drive a backlight module accordingly to output a first color output light accordingly and a first color liquid crystal compensation signal used to drive a liquid crystal panel accordingly; and the second color image optical stimulus is output according to a second color backlight distribution signal used to drive the backlight module to output a second color output light accordingly and a second color liquid crystal compensation signal used to drive the liquid crystal panel accordingly.

5. The displaying method of claim 4, wherein the first color backlight distribution signal and the second color backlight distribution signal are obtained respectively from the target full color image by applying a zoned backlighting technique while the first color liquid crystal compensation signal and the second color liquid crystal compensation signal are derived from the target full color image by calculating with the first color backlight distribution signal and the second color backlight distribution signal, respectively.

6. The displaying method of claim 4, wherein the first partial image optical stimulus of the third color image optical stimulus is output according to the first color liquid crystal compensation signal and a first backlight distribution signal of the third color light used to drive the backlight module to output a first partial third color output light accordingly; and the second partial image optical stimulus of the third color image optical stimulus is output according to the second color liquid crystal compensation signal and a second backlight distribution signal of the third color light used to drive the backlight module to output a second partial third color output light accordingly.

7. The displaying method of claim 6, wherein the first color liquid crystal compensation signal and the second color liquid crystal compensation signal are derived from the target full color image by calculating with a first color backlight distribution signal and a second color backlight distribution signal, respectively.

8. The displaying method of claim 6, wherein the first backlight distribution signal of the third color light and the second backlight distribution signal of the third color light are derived from the target full color image by calculating backward with the first color liquid crystal compensation signal and the second color liquid crystal compensation signal, respectively.

9. The displaying method of claim 6, wherein the first backlight distribution signal of the third color light comprises a first backlight distribution signal of a fourth color light used to drive the backlight module to output a first partial forth color output light and a first backlight distribution signal of a fifth color light used to drive the backlight module to output a first partial fifth color output light;

the second backlight distribution signal of the third color light comprises a second backlight distribution signal of the fourth color light used to drive the backlight module to output a second partial forth color output light and a second backlight distribution signal of the fifth color light used to drive the backlight module to output a second partial fifth color output light;

the first partial third color output light is consisting of the first partial forth color output light and the first partial fifth color output light; and the second partial third color output light is consisting of the second partial forth color output light and the second partial fifth color output light.

10. The displaying method of claim 4, wherein the first partial image optical stimulus of the third color image optical stimulus is output according to the first color liquid crystal compensation signal and a fourth color backlight distribution signal of a fourth color light used to drive the backlight module to output a fourth color output light accordingly; and the second partial image optical stimulus of the third color image optical stimulus is output according to the second color liquid crystal compensation signal and a fifth color backlight distribution signal of a fifth color light used to drive the backlight module to output a fifth color output light accordingly.

11. The displaying method of claim 1, wherein the first color image optical stimulus is output according to a first color backlight distribution signal used to drive a backlight module accordingly to output a first color output light accordingly and a first color liquid crystal compensation signal used to drive a liquid crystal panel accordingly;

and the second color image optical stimulus is output according to a second color backlight distribution signal used to drive the backlight module to output a second color output light accordingly and a second color liquid crystal compensation signal used to drive the liquid crystal panel accordingly.

12. The displaying method of claim 11, wherein the first partial image optical stimulus of the third color image optical stimulus is output according to the first color liquid crystal compensation signal and a first backlight distribution signal of the third color light used to drive the backlight module to output a first partial third color output light accordingly; and the second partial image optical stimulus of the third color image optical stimulus is output according to the second color liquid crystal compensation signal and a second backlight distribution signal of the third color light used to drive the backlight module to output a second partial third color output light accordingly.

13. The displaying method of claim 12, wherein the first color liquid crystal compensation signal and the second color liquid crystal compensation signal are derived from the target full color image by calculating with a first color backlight distribution signal and a second color backlight distribution signal, respectively.

14. The displaying method of claim 12, wherein the first backlight distribution signal of the third color light and the second backlight distribution signal of the third color light are derived from the target full color image by calculating backward with the first color liquid crystal compensation signal and the second color liquid crystal compensation signal, respectively.

15. The displaying method of claim 12, wherein the first backlight distribution signal of the third color light comprises a first backlight distribution signal of a fourth color light used to drive the backlight module to output a first partial forth color output light and a first backlight distribution signal of a fifth color light used to drive the backlight module to output a first partial fifth color output light;

the second backlight distribution signal of the third color light comprises a second backlight distribution signal of the fourth color light used to drive the backlight module to output a second partial forth color output light and a second backlight distribution signal of the fifth color light used to drive the backlight module to output a second partial fifth color output light;

the first partial third color output light is consisting of the first partial forth color output light and the first partial fifth color output light; and the second partial third color output light is consisting of the second partial forth color output light and the second partial fifth color output light.

16. The displaying method of claim 11, wherein the first partial image optical stimulus of the third color image optical stimulus is output according to the first color liquid crystal compensation signal and a fourth color backlight distribution signal of a fourth color light used to drive the backlight module to output a fourth color output light accordingly; and the second partial image optical stimulus of the third color image optical stimulus is output according to the second color liquid crystal compensation signal and a fifth color backlight distribution signal of a fifth color light used to drive the backlight module to output a fifth color output light accordingly.

17. A field sequential color display comprising:

means for providing a target full color image having a first color image optical stimulus of a first color light, a second color image optical stimulus of a second color light and a third color image optical stimulus of a third color light, wherein the third color image optical stimulus comprises a first partial image optical stimulus and a second partial image optical stimulus;

means for displaying a first color field comprising the first color image optical stimulus and a first partial image optical stimulus of the third color image optical stimulus; and means for displaying a second color field comprising the second color image optical stimulus and a second partial image optical stimulus of the third color image optical stimulus;

wherein the first partial image optical stimulus of the third color image optical stimulus is accumulated with the second partial image optical stimulus of the third color image optical stimulus to produce the third color image optical stimulus.

18. The field sequential color display of claim 17, wherein the first color image optical stimulus is output according to a first color backlight distribution signal used to drive a backlight module accordingly to output a first color output light accordingly and a first color liquid crystal compensation signal used to drive a liquid crystal panel accordingly;

and the second color image optical stimulus is output according to a second color backlight distribution signal used to drive the backlight module to output a second color output light accordingly and a second color liquid crystal compensation signal used to drive the liquid crystal panel accordingly.

19. The field sequential color display of claim 18, wherein the first partial image optical stimulus of the third color image optical stimulus is output according to the first color liquid crystal compensation signal and a first backlight distribution signal of the third color light used to drive the backlight module to output a first partial third color output light accordingly; and the second partial image optical stimulus of the third color image optical stimulus is output according to the second color liquid crystal compensation signal and a second backlight distribution signal of the third color light used to drive the backlight module to output a second partial third color output light accordingly.

20. The field sequential color display of claim 19, wherein the first backlight distribution signal of the third color light comprises a first backlight distribution signal of a fourth color light used to drive the backlight module to output a first partial forth color output light and a first backlight distribution signal of a fifth color light used to drive the backlight module to output a first partial fifth color output light;

the second backlight distribution signal of the third color light comprises a second backlight distribution signal of the fourth color light used to drive the backlight module to output a second partial forth color output light and a second backlight distribution signal of the fifth color light used to drive the backlight module to output a second partial fifth color output light;

the first partial third color output light is consisting of the first partial forth color output light and the first partial fifth color output light; and the second partial third color output light is consisting of the second partial forth color output light and the second partial fifth color output light.

* * * * *